US005810063A

United States Patent [19]

Alvern

[11] Patent Number: 5,810,063

[45] Date of Patent: Sep. 22, 1998

[54] DISPLAY APPARATUS

[75] Inventor: Öyvind Alvern, Hjellestad, Norway

[73] Assignee: Alvern-Norway A/S, Norway

[21] Appl. No.: 702,177

[22] Filed: Aug. 23, 1996

[51] Int. Cl.[6] ..... B65B 1/04

[52] U.S. Cl. ..... 141/391; 141/392; 340/311; 340/611

[58] Field of Search ..... 345/1; 141/392, 141/391, 390, 98, 1; 40/660, 661, 733, 310, 311, 610, 611, 584

[56] References Cited

U.S. PATENT DOCUMENTS

| | | | |
|---|---|---|---|
| D. 173,006 | 9/1954 | Anderson | D23/227 |
| D. 173,007 | 9/1954 | Anderson | D23/227 |
| D. 279,483 | 7/1985 | Goldman | D20/10 |
| D. 279,484 | 7/1985 | Goldman | D20/10 |
| D. 366,310 | 1/1996 | Fell | D23/227 |
| 4,408,791 | 10/1983 | Griffin et al. | 141/391 |
| 4,465,209 | 8/1984 | Wilder | 141/98 |
| 4,690,182 | 9/1987 | Knaus | 141/392 |
| 5,058,637 | 10/1991 | Fell | 40/661 |
| 5,184,309 | 2/1993 | Simpson et al. | 141/392 |
| 5,184,655 | 2/1993 | Fell | 40/661 |

FOREIGN PATENT DOCUMENTS

| | | |
|---|---|---|
| 122642 | 2/1995 | Austria . |
| 123343 | 5/1995 | Austria . |
| 0407271A1 | 1/1991 | European Pat. Off. . |
| 62-208396 | 9/1987 | Japan . |
| 850627 | 10/1992 | Japan . |
| 1393062 | 5/1975 | United Kingdom . |
| 2147273 | 5/1985 | United Kingdom . |
| WO 90/08375 | 7/1990 | WIPO . |

*Primary Examiner*—Dennis-Doon Chow
*Attorney, Agent, or Firm*—Finnegan, Henderson, Farabow, Garrett & Dunner, L.L.P.

[57] ABSTRACT

In a display apparatus attachable to a filler gun of a fuel pump, a first display carrying body adapted to be fitted onto the filler gun to display a message on a message card and display information about fuel type delivered from the filler gun, and a second display carrying body releasably attachable to the first display carrying body at a rear end thereof said second display carrying body carrying message indicating that the fuel pump or filler gun is out of order.

10 Claims, 1 Drawing Sheet

DISPLAY APPARATUS

BACKGROUND OF THE INVENTION

The present invention relates to a display apparatus removably attachable to a filler gun a fuel pump, the filler gun including in sequence a barrel, a head portion, and a handle, the barrel joining the head portion at a first junction, and the handle joining the head portion at a second junction.

A such display apparatus suitably comprises a first display carrying body adapted to be fitted onto the filler gun, the carrying body being configured to cover at least a top region of the head portion of the filler gun. Further, there are provided means for attaching said first display carrying body to the filler gun. An upper part of the first display carrying body has means for releasably attaching and displaying a message on a message card, as well as displaying information about fuel type delivered from the filler gun, such as e.g. "UNLEADED 95".

However, there may be situations when a filler gun is unable to deliver fuel from a fuel pump, e.g. by the filler gun being damaged or the fuel pump being inoperative.

In such case, it is important to inform a customer that the filler gun cannot be used, thus signalling that the filler gun or the fuel pump is out of order or out of use.

In the prior art as known from international patent publication number WO90/03375, there is known an indicator assembly for a petrol pump which provides for a cover to be placed over a petrol pump filler gun, in order to indicate that it is out of use. The cover is adapted to be connected by clips to the gun to cover same. The cover slideably receives a display plate which may carry the wording for example "OUT OF USE". The display plate in being applied to the cover locks one of the clips also prevents a removal of the assembly from the nozzle without removal of the information plate.

Although the prior art device may be useful, it is expensive and based on a two-part structure. Further, it is of such design that it would shield any display carrying body on the filler gun which displays a message and information about fuel type normally delivered by the filler gun.

SUMMARY OF THE INVENTION

The present invention therefore aims at providing in a display apparatus some means for easily indicating that a fuel filler gun is inoperative, said means being easy to install and cheap in manufacturing.

According to the present invention, said display apparatus further comprises a second display carrying body which is releasably attachable to said first display carrying body adjacent said second junction, said second display carrying body when attached to said first display carrying body extending over at least a part of said handle and resting thereon.

Suitably, said second display carrying body is wider than said handle.

Also, said second display carrying body may be provided with means for engaging a portion of said handle.

Although not to be construed in a limiting sense of the invention, said second display carrying body may be a substantially flat panel.

Said second display carrying body when attached to said first display carrying body carries a message indicating that a fuel pump for filler gun is out of order.

BRIEF DESCRIPTION OF THE DRAWINGS

The invention is now to be further described with reference to the attached drawings illustrating a non-limiting embodiment of the present invention.

DESCRIPTION OF THE PREFERRED EMBODIMENTS

Figure 3:
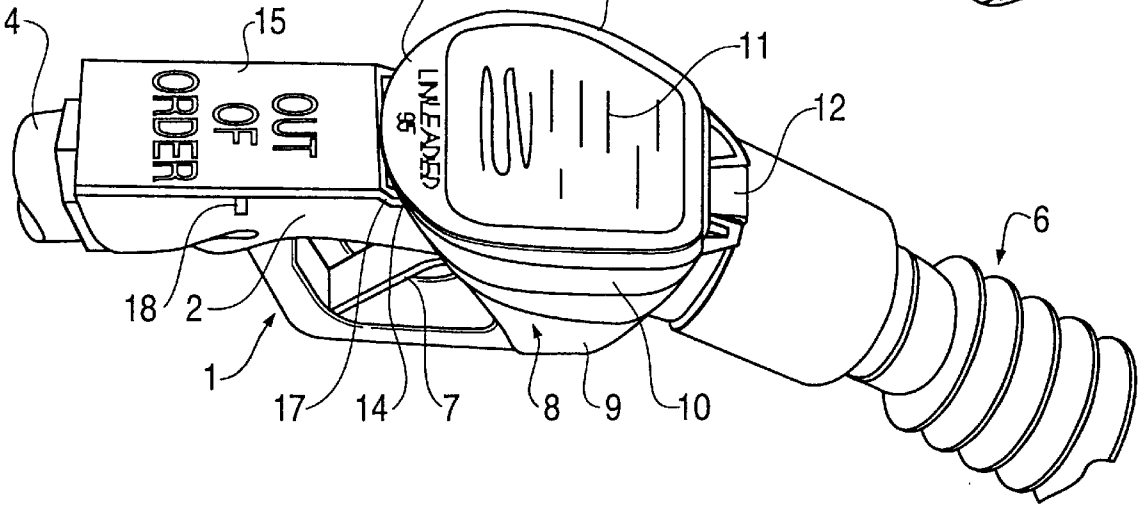
FIG. 3 illustrates from a slightly different angle the second display carrying body installed on the first display carrying body as shown in FIG. 2.
Figure 1:
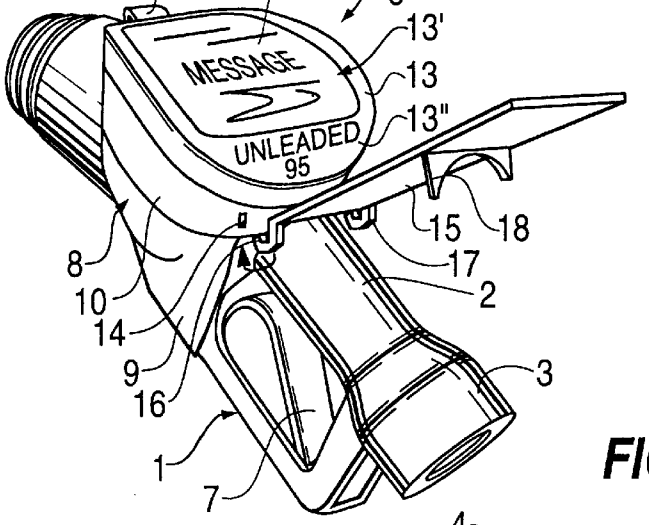
FIG. 1 illustrates installation of a second display carrying body on a first display carrying body of the display apparatus according to the invention.

In FIG. 1 there is shown a filler gun 1 having a handle 2 and a fuel inlet portion 3. A hose 4 (see FIG. 3) from a fuel pump (not shown) supplies fuel to the filler gun 1 in a conventional manner. The fuel gun has a head portion as indicated by reference numeral 5 in which is conventionally contained operating valves etc. Also, the filler gun has an outlet portion indicated by reference numeral 6 which may contain means for fuel vapour recovery. Also, the gun has a conventional operating lever 7 at the handle 2.

All details relating to the fuel filler gun as just described are conventional and do not form part of the invention as such.

A first display carrying body 8 is adapted to be fitted onto the filler gun 1, the carrying body being configured to cover at least a top region of the head portion 5 of the filler gun 1. A lower member 9 of said first display carrying body 8 forms means for attaching the first display carrying body to the filler gun. However, said means for attaching could be any suitably alternative means, such as e.g. straps.

The first display carrying body has an upper member 10, suitably attached to the lower member 9 and providing means for releasably attaching and displaying messages on a display message card 11. To the upper member 10 is suitably attachable, e.g. by a hinge connection 12 a top member 13 e.g. formed substantially as a frame as indicated on the drawing figures or as a lid. If a frame type of top member is used as suggested in the drawing figures, the message card 11 is readily viewable through an open space 13' in said top member 13. Also, the top member 13 may be provided with a portion 13" for displaying information about fuel type delivered from the filler gun, e.g. "UNLEADED 95".

At a rear region of the first display carrying body, suitably in the rear part of the upper member 10, there is provided a pair of holes 14 of which only one is visible on FIG. 1.

In order to inform a customer that the filler gun is out of order, there is provided, according to the invention a second display carrying body 15 having at its front end engagement means 16, 17, e.g. hooks, for engaging said holes 14 in the first display carrying body.

Figure 2:
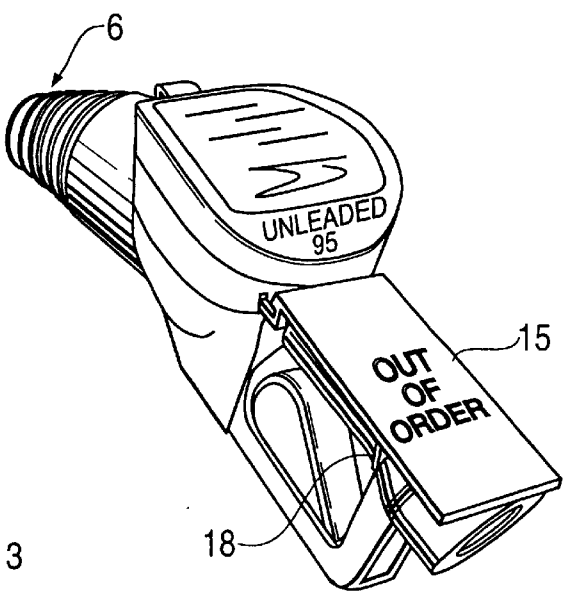
FIG. 2 illustrates the second display carrying body installed on the first display carrying body.

The second display carrying body 15 is thus releasably attachable to the first display carrying body adjacent the junction between the said portion 5 and the handle 2. As clearly seen from FIGS. 2 and 3, the second display carrying body when attached to the first display carrying body extends over at least a part of the filler gun handle and rests thereon. In order to provide some lateral stabilisation of the second display carrying body when laying over the handle 2, means 18 may be provided on the lower side of said second display carrying body 15 to ride on the handle 2 at a rear region thereof, as clearly indicated on drawing FIGS. 2 and 3. Suitably, as is visible from FIG. 2, the second display carrying body 15 is wider than the handle. This means that if a customer inadvertently does not note the "out of order"

message, the customer will feel that it is not possible to fully grip the filler gun in conventional manner and therefore be fully aware that there is something wrong with the filler gun.

Although it is shown on the drawings that the second display carrying body 15 could be a substantially flat panel, it could be visualized that the second display carrying body could be slightly curved or have a configuration which would immediately be noted by a customer when attempting to grip the handle 2 of the filler gun.

I claim:

1. Display apparatus removably attachable to a filler gun of a fluid pump, the filler gun including in sequence a barrel, a head portion, and a handle, the barrel joining the head portion at a first junction, and the handle joining the head portion at a second junction, said display apparatus comprising:

a first display carrying body having front and rear ends adapted to be fitted onto the filler gun substantially covering at least a top region of the head portion of the filler gun, said rear end of said first display carrying body including a female attaching portion;

means for attaching said first display carrying body to the filler gun;

means provided at an upper part of the first display carrying body for releasably attaching and displaying a message; and a second display carrying body releasably attachable to said first display carrying body adjacent to said rear end with a male attaching portion engage with said female attaching portion and disposable over at least part of the handle and resting thereon.

2. Display apparatus removably attachable to a fluid pump filler gun, the filler gun including in sequence a barrel, a head portion, and a handle, said display apparatus comprising:

a first display carrying body having a front end and a rear end removably attachable to the head portion of the filler gun, said first display carrying body including a message platform for displaying a message, the rear end of said first display carrying body including a female attaching portion; and a second display carrying body having a front end and a rear end, the front end including a male attaching portion for engaging the female attaching portion of the front display carrying body, said second display carrying body being disposable over at least a part of the handle.

3. Display apparatus according to claims 1 or 2, wherein said second display carrying body is wider than said handle.

4. Display apparatus according to claims 1 or 2, wherein said second display carrying body has means for engaging a portion of said handle.

5. Display apparatus according to claims 1 or 2, wherein said second display carrying body is a substantially flat panel.

6. Display apparatus according to claims 1 or 2, wherein said second display carrying body carries a message indicating that the fluid pump or filler gun is out of order.

7. Display apparatus according to claims 1 or 6, wherein said second display carrying body releasably attaches to said first display carrying body.

8. Display apparatus according to claims 1 or 6, wherein said second display carrying body pivotally attaches to said first display carrying body.

9. Display apparatus according to claims 1 or 6, wherein said message displayed on said first display carrying body is provided on a removable message card.

10. Display apparatus according to claims 1 or 6, wherein said first display carrying body includes a portion for displaying information about fuel type delivered from the filler gun.

* * * * *

UNITED STATES PATENT AND TRADEMARK OFFICE

CERTIFICATE OF CORRECTION

PATENT NO.: 5,810,063

DATED: September 22, 1998

INVENTOR(S): Öyvind Alvern

It is certified that an error appears in the above-identified patent and that said Letters Patent is hereby corrected as shown below:

Claim 7, Col. 4, Line 24, Change "6" to --2--.

Claim 8, Col. 4, Line 27, Change "6" to --2--.

Claim 9, Col. 4, Line 30, Change "6" to --2--.

Claim 10, Col. 4, Line 34, Change "6" to --2--.

Signed and Sealed this

Twenty-second Day of December, 1998

*Attest:*

Bruce Lehman

BRUCE LEHMAN

*Attesting Officer*

*Commissioner of Patents and Trademarks*